US008977150B2

(12) United States Patent
Yamamoto et al.

(10) Patent No.: US 8,977,150 B2
(45) Date of Patent: Mar. 10, 2015

(54) IMAGE FORMING APPARATUS INCLUDING A CONTROLLER CONFIGURED TO REGULATE A POTENTIAL DIFFERENCE BETWEEN A PHOTOCONDUCTOR AND A DEVELOPING MEMBER

(71) Applicants: Shin Yamamoto, Osaka (JP); Shin Murayama, Hyogo (JP); Yoshio Sakagawa, Hyogo (JP); Yuji Nagatomo, Osaka (JP)

(72) Inventors: Shin Yamamoto, Osaka (JP); Shin Murayama, Hyogo (JP); Yoshio Sakagawa, Hyogo (JP); Yuji Nagatomo, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 55 days.

(21) Appl. No.: 13/677,873

(22) Filed: Nov. 15, 2012

(65) Prior Publication Data

US 2013/0142530 A1 Jun. 6, 2013

(30) Foreign Application Priority Data

Dec. 2, 2011 (JP) ..... 2011-264233

(51) Int. Cl.

| | |
|---|---|
| ***G03G 15/08*** | (2006.01) |
| ***G03G 15/06*** | (2006.01) |
| ***G03G 15/22*** | (2006.01) |
| ***G03G 15/00*** | (2006.01) |

(52) U.S. Cl.

CPC ..... *G03G 15/08* (2013.01); *G03G 15/22* (2013.01); *G03G 15/065* (2013.01); *G03G 15/50* (2013.01)

USPC ..... 399/53; 399/55; 399/51

(58) Field of Classification Search

USPC ..... 399/53, 55, 50, 51

See application file for complete search history.

(56) References Cited

U.S. PATENT DOCUMENTS

| | | | | |
|---|---|---|---|---|
| 4,640,883 | A * | 2/1987 | Oka | 430/54 |
| 5,970,279 | A * | 10/1999 | Sakaizawa et al. | 399/46 |
| 6,438,331 | B2 * | 8/2002 | Sakaizawa et al. | 399/50 |
| 2008/0267641 | A1 | 10/2008 | Konishi et al. | |
| 2009/0208252 | A1 | 8/2009 | Nakagawa et al. | |
| 2010/0028057 | A1 | 2/2010 | Yamada et al. | |

FOREIGN PATENT DOCUMENTS

| | | |
|---|---|---|
| JP | 2008-058677 | 3/2008 |
| JP | 2009-134134 | 6/2009 |

* cited by examiner

*Primary Examiner* — G. M. Hyder

(74) *Attorney, Agent, or Firm* — Harness, Dickey & Pierce, P.L.C.

(57) ABSTRACT

An image forming apparatus includes a rotatable photoconductor, a charging unit, an exposure unit to expose the photoconductor to reduce an electrical potential at the photoconductor, a developing unit to charge the toner held on a toner bearing member with friction and attract the toner to the exposed portion on the photoconductor by supplying a development voltage from a first power source and using an electrical potential difference between the toner bearing member and the photoconductor in the development area, a reverse development voltage controller to supply a reverse development voltage while a non-charged portion on the photoconductor passes the development area, and a developer reducing potential applier to supply a development restraining potential and an absolute value smaller than a target charging potential to the photoconductor while the reverse development voltage is supplied.

10 Claims, 4 Drawing Sheets

IMAGE FORMING APPARATUS INCLUDING A CONTROLLER CONFIGURED TO REGULATE A POTENTIAL DIFFERENCE BETWEEN A PHOTOCONDUCTOR AND A DEVELOPING MEMBER

CROSS-REFERENCE TO RELATED APPLICATIONS

This patent application is based on and claims priority pursuant to 35 U.S.C. §119 to Japanese Patent Application No. 2011-264233, filed on Dec. 2, 2011, in the Japan Patent Office, the entire disclosure of which is hereby incorporated by reference herein.

BACKGROUND OF THE INVENTION

1. Field of the Invention

Embodiments of the present invention relate to an image forming apparatus in which a latent image formed on the surface of an image bearing member is developed into a toner image by a development device employing a one-component developer developing method for transfer onto a recording medium.

2. Description of the Related Art

Electrophotographic image forming apparatuses generally employ developing methods using either one-component developer or two-component developer. As disclosed, for example, in Japanese Patent Application Publication No. 2008-058667 (JP-2008-058677-A), the one-component developer developing method uses only toner to develop an image, whereas the two-component developer developing method uses developer that includes both toner and carrier. Generally, the one-component developer developing method requires a simpler configuration, and therefore can be used in an easily-maintainable, low-cost developing device.

In the one-component developer developing method, as toner carried on the surface of a toner bearing member passes beneath a layer thickness regulating member as the toner bearing member rotates, the toner is slidably pressed hard against the surface of the toner bearing member and charged by friction (i.e., triboelectrically charged) while it forms a thin layer. Then, as the toner bearing member continues to rotate, the thus-regulated toner is brought to face an image bearing member, where the toner is electrically attracted to an electrostatic latent image formed on the surface of the image bearing member, so that the electrostatic latent image can be developed into a visible toner image.

In the one-component developer developing method, a non-charged surface of the image bearing member passes a development area while an image formation start operation is performed before the start of image formation and/or while an image formation end operation is performed after the image formation. At this time, a very small amount of toner may be attracted to the surface of the image bearing member facing the toner bearing member in the development area from the surface of the toner bearing member. Once this unnecessary attraction of toner occurs, even though the amount of toner per attraction is very small, the accumulated amount of waste toner after repeated attractions becomes too large to ignore. Therefore, it is desired to prevent occurrence of the unnecessary attraction of toner.

Most contemporary image forming apparatuses are designed to uniformly charge the surface of the image bearing member to a predetermined potential having the same polarity as that of the toner used therein, and expose the surface of the image bearing member based on image data so as to reduce the potential at the exposed portion (i.e., a latent image formed portion). By using an electric potential difference between the latent image formed portion and the surface of the toner bearing member, toner on the surface of the toner bearing member is attracted to the latent image formed portion. To prevent the unnecessary attraction of toner in this configuration, it is useful to supply a voltage having the opposite polarity to a development voltage that is output for image formation while the non-charged surface of the latent image bearing member is passing over the development area.

With this method, when the non-charged surface of the latent image bearing member passes the development area, an electric field that can hold toner on the toner bearing member in the development area can reliably be generated, thereby preventing the unnecessary attraction of toner reliably. Further, such a reversing development field can be formed by switching the output polarity of the developer power source that outputs a forward development voltage to the toner bearing member to the reverse development voltage and supplying the reverse development voltage to the toner bearing member, thereby achieving a simple configuration. Accordingly, in comparison to a configuration in which a power source for supplying the reverse development voltage is provided separately from the developer power source, a low-cost configuration can be achieved, which is suitable for the one-component developer developing method that also has a merit of low cost.

As described above, however, since the one-component developer developing method causes the layer thickness regulating member to press toner hard against the surface of the toner bearing member to increase the amount of charged toner, toner may form a film on the surface of the toner bearing member after repeated image formation, which is called "toner filming". Once toner filming occurs, when the toner on the toner bearing member passes by the layer thickness regulating member, the toner cannot slidably contact the surface of the toner bearing member with friction, and frictional charging of toner cannot be performed reliably. Accordingly, the amount of charged toner to be conveyed to the development area becomes reduced or short, which makes the toner less susceptible to the reversing development field. As a result, a force to attract toner to the toner bearing member is decreased because of the reversing development field, and unnecessary attraction of toner occurs even if the reversing development field is generated.

If a power source having a high capacity capable of outputting a large voltage is used as a developer power source, a sufficiently large reverse development voltage can be output to the toner bearing member in the image formation start operation and the image formation end operation. In this case, a difference in potential between the surface of the latent image bearing member (substantially 0 [V]) and the surface of the toner bearing member in the development area can be large, and a substantially strong reversing development field can be generated in the development area. Therefore, even if the amount of charged toner is not sufficient, the toner bearing member can hold the toner reliably, and therefore, even if toner filming occurs due to age, unnecessary attraction of toner can be prevented.

However, a power source having a high capacity is rather expensive, and therefore it is not preferable to use such a high-capacity power source as a developer power source in an image forming apparatus employing a one-component developer developing method having a merit of low cost. Therefore, it is desired to produce a new method that, even when an inexpensive, low-capacity developer power source is used to output a reverse development voltage to the toner bearing member, a sufficiently strong reversing development field is generated in the development area to hold insufficiently-charged toner to the toner bearing member reliably.

SUMMARY OF THE INVENTION

The present invention describes a novel image forming apparatus for transforming an image to which toner is attracted onto a recording medium, and which includes a rotatable image bearing member, a charging unit, an exposure unit, a developing unit, a reverse development voltage controller, a developer reducing potential applier, and a controller. The rotatable image bearing member carries a latent image on a surface thereof. The charging unit is connected to a first power source to charge the surface of the image bearing member to a target charging potential having the same polarity as the toner. The exposure unit exposes the charged surface of the image bearing member based on image data to reduce an electric potential at an exposed portion of the surface of the image bearing member. The developing unit includes a toner bearing member to carry the toner on a surface thereof for developing the latent image on the image bearing member with the toner and a layer thickness regulator to regulate a thickness of layer of the toner carried on the surface of the toner bearing member. The developing unit charges the toner with friction by slidably contacting the surface of the toner bearing member and conveying the charged toner along with movement of the surface of the toner bearing member to a development area where the toner faces the latent image on the surface of the image bearing member. The developing unit is connected to a second power source to output a development voltage having the same toner polarity as the toner bearing member, uses a difference in potential between the surface of the toner bearing member and the exposed portion of the surface of the image bearing member in the development area, and attracts the toner on the toner bearing member to the exposed portion on the surface of the image bearing member with the second power source. The reverse development voltage controller is connected to the second power source. The developer reducing potential applier is connected to the first power source. The controller controls the reverse development voltage controller to cause the second power source to supply a reverse development voltage having an opposite polarity to the development voltage to the toner bearing member while a non-charged portion on the surface of the image bearing member passes the development area, and the developer reducing potential applier to cause the first power source to supply a development restraining potential having the same polarity as the toner and an absolute value smaller than the target charging potential, to the surface of the latent image bearing member that passes the development area while the reverse development voltage is supplied from the second power source.

The developer reducing potential applier may apply the development restraining potential to the surface of the image bearing member by causing the charging unit to charge the surface of the image bearing member to the development restraining potential.

The developer reducing potential applier may apply the development restraining potential to the surface of the image bearing member by causing the charging unit to charge the surface of the image bearing member to have a polarity same as the regular charging polarity of toner and an electrical potential with the absolute value greater than the development restraining potential and then causing the exposure unit to expose the surface of the image bearing member to reduce the electrical potential to the development restraining potential.

The image bearing member may be a photoconductor with a conductive layer being formed on an outer surface of a conductive substrate thereof. The developer reducing potential applier may apply the developer reducing potential to the surface of the image bearing member by supplying a voltage to the conductive substrate of the image bearing member.

The developer reducing potential applier may apply the developer reducing potential to substantially match a difference in potential generated between a potential at the surface of the toner bearing member to which the reverse development voltage is output and the development restraining potential with a difference in potential generated during the image formation between a potential at the surface of the toner bearing member to which the development voltage is output and a potential at a non-exposed portion on the surface of the image bearing member.

A period in which the reverse development voltage controller outputs the reverse development voltage from the first power source to the toner bearing member may correspond to an image formation start operation period before start of image formation or an image formation end operation period after completion of image formation.

The developer reducing potential applier may apply the development reducing potential to the image bearing member such that the difference in potential generated between the potential at the surface of the toner bearing member to which the reversing development voltage is output and the development restraining potential is set to a range of from 250 [V] to 350 [V].

BRIEF DESCRIPTION OF THE SEVERAL VIEWS OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION OF THE INVENTION

Figure 1:
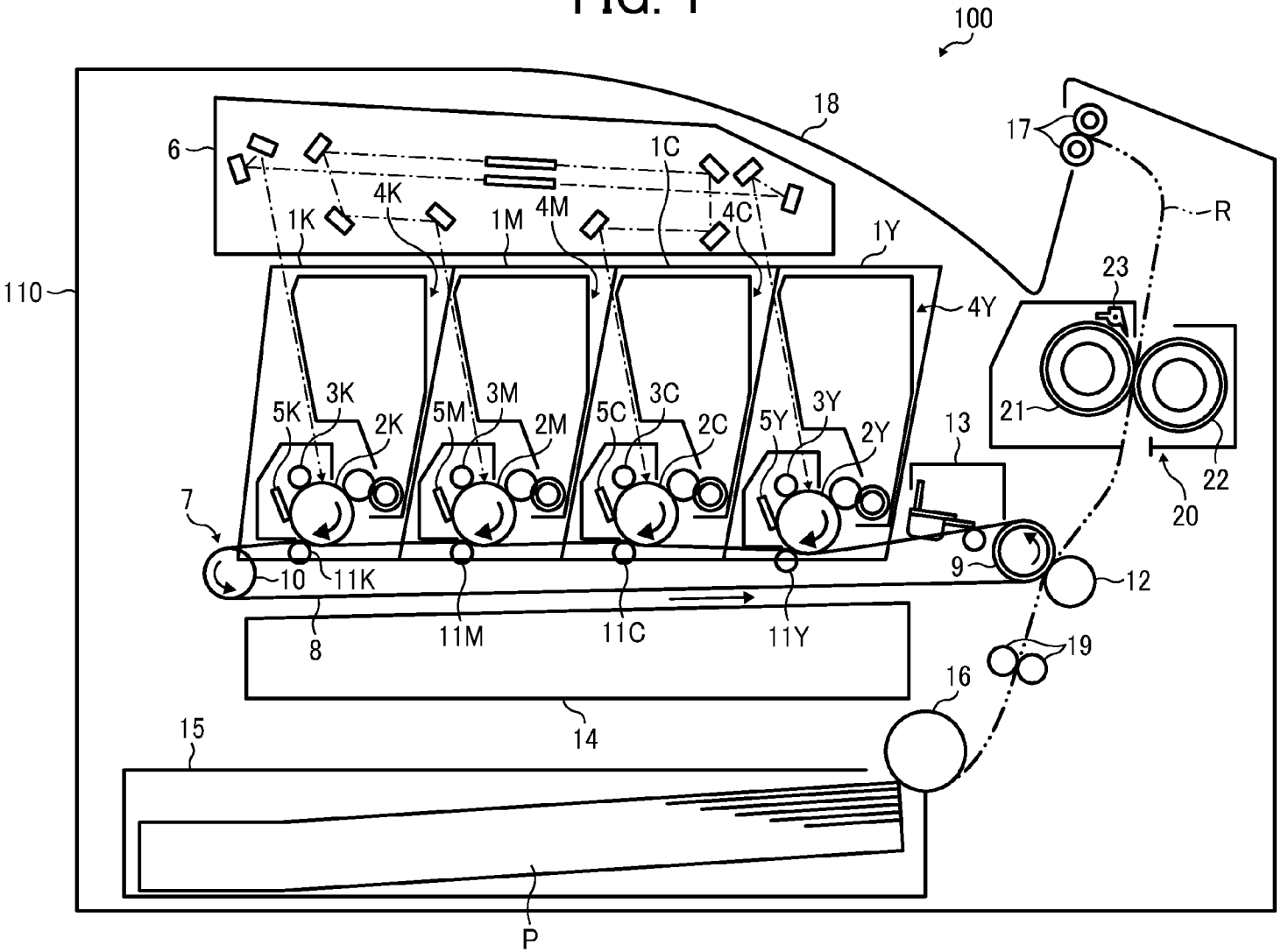
FIG. 1 is a diagram illustrating a schematic configuration of a color image forming apparatus according to an exemplary embodiment of the present invention.

It will be understood that if an element or layer is referred to as being "on", "against", "connected to" or "coupled to"

another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to the present invention. Elements having the same functions and shapes are denoted by the same reference numerals throughout the specification and redundant descriptions are omitted. Elements that do not require descriptions may be omitted from the drawings as a matter of convenience. Reference numerals of elements extracted from the patent publications are in parentheses so as to be distinguished from those of exemplary embodiments of the present invention.

The present invention includes a technique applicable to any image forming apparatus, and is implemented in the most effective manner in an electrophotographic image forming apparatus.

In describing preferred embodiments illustrated in the drawings, specific terminology is employed for the sake of clarity. However, the disclosure of the present invention is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, preferred embodiments of the present invention are described.

A description is given of an exemplary embodiment applicable to an electrophotographic color image forming apparatus.

FIG. 1 illustrates a schematic diagram of a configuration of a color image forming apparatus 100 according to an exemplary embodiment of the present invention.

The image forming apparatus 100 includes four process units 1Y, 1C, 1M, and 1K, each of which is detachably attachable to a main body 110. The process units 1Y, 1C, 1M, and 1K have a similar configuration to each other, except for containing different toner colors which are yellow toner, cyan toner, magenta toner, and black toner, respectively. Yellow toner, cyan toner, magenta toner, and black toner contained in the process units 1Y, 1C, 1M, and 1K correspond to respective color separation components.

In the main body 110, the image forming apparatus 100 further includes an optical writing device 6, a transfer unit 7, a secondary transfer roller 12, a belt cleaning unit 13, a sheet tray 15, a sheet feeding roller 16, a pair of sheet discharging rollers 17, a sheet discharging tray 18, a pair of registration rollers 19, and a fixing unit 20.

Figure 2:
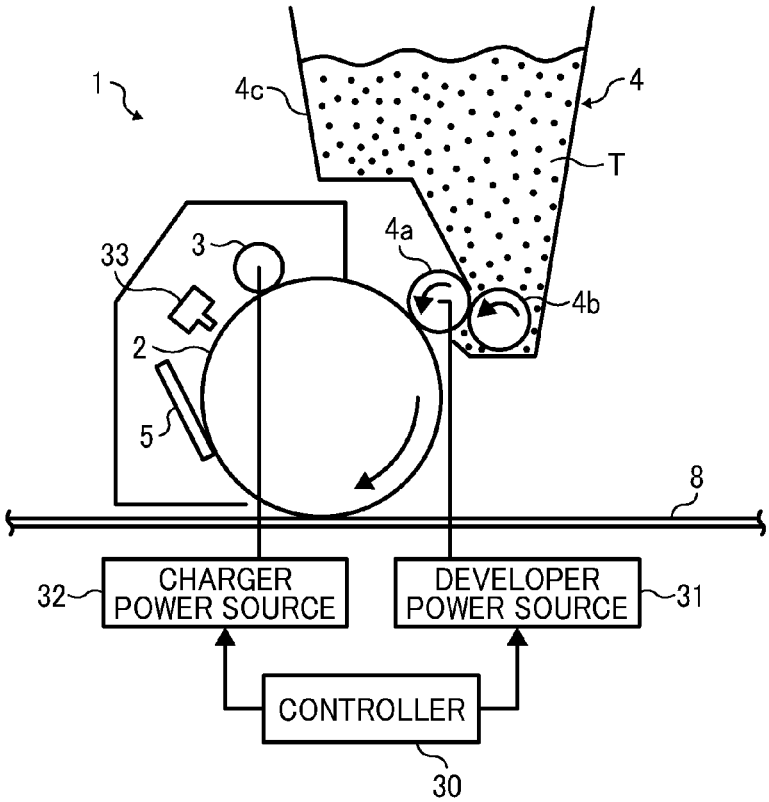
FIG. 2 is a diagram illustrating a schematic configuration of a process unit provided in the color image forming apparatus of FIG. 1.

FIG. 2 illustrates a schematic diagram of a configuration of one process unit 1.

Specifically, each of the process units 1Y, 1C, 1M, and 1K includes a photoconductors 2 (i.e., photoconductors 2Y, 2C, 2M, and 2K) serving as an image bearing member to carry a latent image formed on a surface thereof, a charging roller 3 (i.e., charging members 3Y, 3C, 3M, and 3K) serving as a charging unit that charges the surface of the photoconductor 2 to a target charging potential having a same polarity as the toner (i.e., a negative polarity in this embodiment), a developing unit 4 (i.e., developing units 4Y, 4C, 4M, and 4K) to supply the toner to the surface of the photoconductor 2, and a cleaning blade 5 (i.e., cleaning blades 5Y, 5C, 5M, and 5K) serving as a cleaning member to clean the surface of the photoconductor 2 by removing residual toner remaining thereon. The detailed reference numerals such as the photoconductors 2Y, 2C, 2M, and 2K are denoted in FIG. 1 only, and the process unit 1 illustrated in FIG. 2 can be any one of the process units 1Y, 1C, 1M, and 1K.

In FIG. 1, the optical writing device 6 is disposed above the process units 1Y, 1C, 1M, and 1K. The optical writing device 6 serves as an exposure unit that exposes the surface of the photoconductor 2 charged by the charging roller 3 based on image data to reduce a potential on an optically exposed portion on the surface of the photoconductor 2.

Further, the transfer unit 7 is disposed below the process units 1Y, 1C, 1M, and 1K. The transfer unit 7 includes an intermediate transfer belt 8 that is an endless belt serving as an intermediate transfer member. The intermediate transfer belt 8 is looped and wound around a driving roller 9 and a driven roller 10 with tension and is disposed to rotate in an endless manner in a direction indicated by arrow in FIG. 1.

Primary transfer rollers 11Y, 11C, 11M, and 11K illustrated in FIG. 1, each serving as a primary transfer member, are disposed facing the photoconductors 2Y, 2C, 2M, and 2K, respectively. The primary transfer rollers 11Y, 11C, 11M, and 11K press contact an inside surface of a loop of the intermediate transfer belt 8. Primary transfer nips are formed between the primary transfer rollers 11Y, 11C, 11M, and 11K and the corresponding photoconductors 2Y, 2C, 2M, and 2K with the intermediate transfer belt 8 interposed therebetween.

The secondary transfer roller 12 serving as a secondary transfer member is disposed facing the driving roller 9. The secondary transfer roller 12 presses contact an outer surface of the loop of the intermediate transfer belt 8. A secondary nip is formed between the secondary transfer roller 12 and the driving roller 9 with the intermediate transfer belt 8 interposed therebetween.

Further, the belt cleaning unit 13 is disposed at the right end on the outer surface of the loop of the intermediate transfer belt 8 as illustrated in FIG. 1 to clean the surface of the intermediate transfer belt 8. A waste toner transfer hose extends from the belt cleaning unit 13 to be connected to an opening of a waste toner container 14 that is disposed below the transfer unit 7.

At the lower side of the main body 110, the sheet tray 15 that contains a sheet stack including a recording paper P serving as a recording medium therein and the sheet feeding roller 16 that feeds and conveys the recording paper P from the sheet tray 15 are disposed. At the upper side of the main body 110, the pair of sheet discharging rollers 17 is disposed to eject the recording paper P to the outside of the main body 110, and the sheet discharging tray 18 is disposed to stock the discharged recording paper P. Further, inside the main body 110, a sheet conveyance path R is defined from the below-disposed sheet tray 15 to the above-disposed sheet discharging tray 18 to guide the recording paper P contained in the sheet tray 15. In the sheet conveyance path R, the pair of registration rollers 19 is disposed between the sheet feeding roller 16 and the secondary transfer roller 12.

The fixing unit 20 is disposed between the secondary transfer roller 12 and the sheet discharging roller 17 along the sheet conveyance path R to fix the toner image formed on the recording paper P to the surface of the recording paper P. The fixing unit 20 includes a fixing roller 21, a pressure roller 22, and a separation member 23. The fixing roller 21 serves as a fixing member to be heated by a heater. The pressure roller 22 serves as a member disposed opposite and contacting the fixing roller 21, where a fixing nip is formed. The separation member 23 is configured to separate the recording paper P from the fixing roller 21.

In this embodiment, the fixing nip is formed at a pressed portion where a pressing unit causes the fixing roller 21 and the pressure roller 22 to press against each other. However, the configuration of the fixing unit 20 of the present invention is not limited thereto. For example, at least one of the fixing member and the opposed member can be a dielectric endless belt to be pressed by a roller or a pad against an opposed member. Alternatively, a fixing member and an opposed member may not press against each other but can contact with each other without application of pressure.

Next, referring to FIG. 2, a more detailed description is given of the configuration of the developing unit 4.

The developing unit 4 employed in the exemplary embodiment serves as a developing unit having a configuration for operation using one-component developer. The developing unit 4 includes a developing roller 4*a*, a regulating roller 4*b*, and a development case 4*c*.

The developing roller serves as a toner bearing member and is disposed at the bottom of development case 4*c* in which toner T is contained. The developing roller 4*a* rotates with the photoconductor 2 in a dragged manner in a same direction as the photoconductor 2 moves at a contact portion where the photoconductor 2 and the developing roller 4*a* contact. Further, the developing roller 4*a* constantly contacts the regulating roller 4*b* inside the development case 4*c*. The regulating roller 4*b* that serves as a layer thickness regulating member rotates in a counter direction with respect to the developing roller 4*a*.

The toner T held on a surface of the developing roller 4*a* is conveyed to a contact portion where the developing roller 4*a* and the regulating member 4*b* contact, so that the thickness of layer of the toner T can be regulated and, at the same time, the toner T can slidably contacted to the surface of the developing roller 4*a* so as to electrically charge the surface of the developing roller 4*a* with friction. Then, the thin-layered toner T after the contact point is conveyed along with rotation of the developing roller 4*a* to a development area where the developing roller 4*a* and the photoconductor 2 facing each other.

The developing unit 4 further includes a controller 30, a developer power source 31, a charger power source 32, and a charged electricity discharging unit 33.

Further, the developer power source 31 supplies a development voltage to the developing roller 4*a* during image formation. The development voltage supplied to charge the developing roller 4*a* has the same negative polarity as the toner. The value of this development voltage is optionally determined between an electric potential at an exposed portion (i.e., a portion where a latent image is formed) on the surface of the photoconductor 2 exposed by the optical writing device 6 and an electric potential at a charged portion (i.e., a portion where a latent image is not formed) on the surface of the photoconductor 2 charged by the charging roller 3. By outputting or supplying such development voltage to the developing roller 4*a*, a difference in electric potential between the surface of the developing roller 4*a* and the latent image formed portion on the surface of the photoconductor 2 in the development area is generated. According to this action, a development electric field is generated in the development area so that the toner T charged to the same negative polarity as the toner T is transported from the developing roller 4*a* to be attracted to the latent image area on the surface of the photoconductor 2.

Referring to FIG. 1, a description is given of basic functions of the image forming apparatus 100.

Upon receiving input of instruction to start image formation, the image forming apparatus 100 initiates an image formation start operation. Specifically, the photoconductor 2 (i.e., the photoconductors 2Y, 2C, 2M, and 2K) of the process unit 1 (i.e., the process unit 1Y, 1C, 1M, and 1K) is rotated by a driving unit in a clockwise direction in FIG. 1. At the same time, the developing roller 4*a* and the regulating roller 4*b* of the developing unit 4 (i.e., the developing units 4Y, 4C, 4M, and 4K) of the process unit 1 and the intermediate transfer belt 8 are rotated.

Once the rotation speed of the photoconductor 2 becomes settled at a target speed, the image formation starts at a predetermined timing thereafter, and then the surface of the photoconductor 2 is uniformly charged to a predetermined polarity (i.e., a negative polarity in this case) by the charging roller 3. The optical writing device 6 emits (exposes) laser light beam to the charged surface of the photoconductor 2 so that an electrostatic latent image is formed on the surface of the photoconductor 2. Image data used for exposure to each photoconductor 2 is image data of a corresponding single color after color separation of a desired full-color image into yellow, cyan, magenta, and black. As described above, the electrostatic latent image formed on the photoconductor 2 is supplied with the toner T from the developing roller 4*a* of the developing unit 4 so as to be developed into a visible toner image.

Further, after the image formation has started, the primary transfer roller 11 is supplied with a primary transfer voltage that has the opposite (i.e., positive) polarity to the toner to which constant voltage control or constant electrical current control is performed. By so doing, a transfer electric field is generated at the primary transfer nip formed between the primary transfer roller 11 and the corresponding photoconductor 2. Then, due to the transfer electric fields, the toner images of respective single colors formed on the photoconductors 2Y, 2C, 2M, and 2K of the process units 1Y, 1C, 1M, and 1K are transferred sequentially onto the intermediate transfer belt 8. Consequently, the intermediate transfer belt 8 holds a full-color toner image on the surface thereof.

Further, residual toner remaining on the surface of the photoconductor 2 after the toner image is transferred is removed by the cleaning blade 5. The toner removed by the cleaning blade 5 is conveyed via the waste toner transporting hose to the waste toner container 14 disposed below the transfer unit 7. The charged electricity discharging unit 33 removes remaining electric charge on the surface of the photoconductor 2 after cleaning by removing the residual toner. With this electrically discharging operation by the charged electricity discharging unit 33, the photoconductor is initialized to substantially 0 [V] and the electric potential at the surface of the photoconductor 2 is initialized so as to get ready for the next image formation.

Further, the charger power source 32 supplies a voltage to the charging roller 3 during image formation under control of the controller 30.

Further, when the image formation starts, the sheet feeding roller 16 disposed at the lower part of the image forming apparatus 100 is rotated to feed and convey the recording paper P contained in the sheet tray 15 toward the sheet conveyance path R. The recording paper P fed to the sheet conveyance path R is conveyed to a secondary transfer nip formed between the secondary transfer roller 12 and the pair of registration rollers 19 in synchronization with movement of the pair of registration rollers 19. At this time, the secondary transfer roller 12 is supplied with a secondary transfer voltage having the opposite polarity (i.e., positive polarity) to the toner of the toner image formed on the intermediate transfer belt 8, thereby forming a transfer electric field at the secondary transfer nip. With the transfer electric field formed at the secondary transfer nip, the toner images transferred onto the intermediate transfer belt 8 is transferred onto the recording paper P to form a full-color image thereon.

The recording paper P having the toner image on one surface thereof is conveyed to the fixing unit 20. At the fixing unit 20, the fixing roller 21 and the pressure roller 22 press the recording paper P by application of heat and pressure, thereby fixing the toner image onto the recording paper P. The recording paper P having the toner image fixed thereto is separated from the fixing roller 21 by the separation member 23 and is discharged by the sheet discharging roller 17 to the sheet discharging tray 18. Residual toner remaining on the surface of the intermediate transfer belt 8 after transfer of the toner images is removed and cleaned by the belt cleaning unit 13. The thus removed toner is conveyed and collected to the waste toner container 14.

The above-described steps indicate image forming operation for forming a full-color image on the recording paper P. However, any one of the process units 1Y, 1C, 1M, and 1K can be selectively used to form a single color image. Alternatively, two or three process units 1 are used to form a two-color or three-color image.

Figure 3:
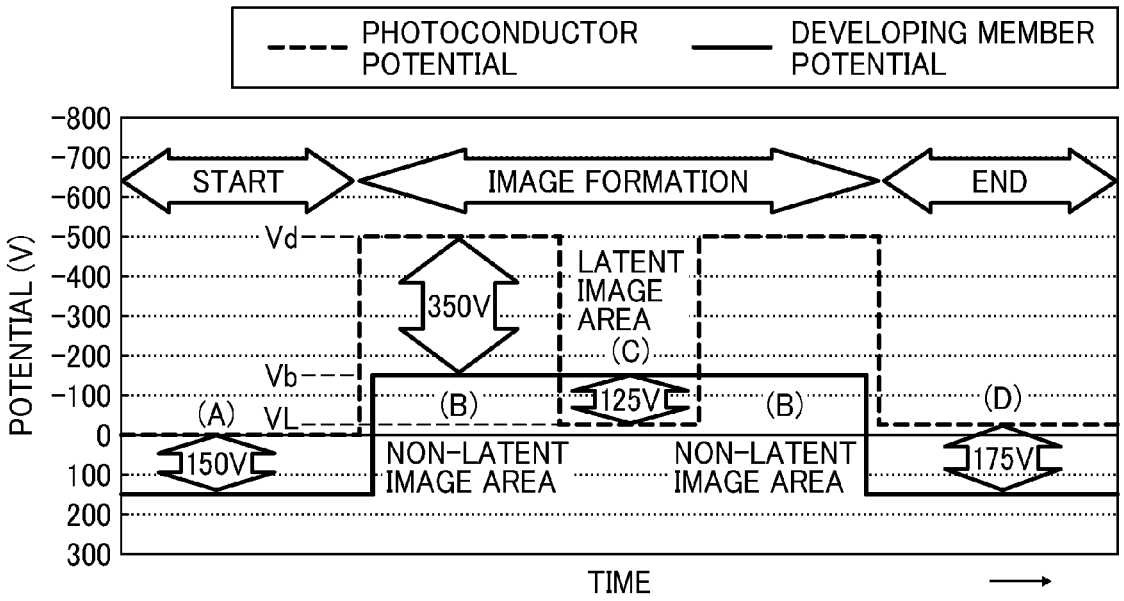
FIG. 3 is a diagram illustrating an electric potential sequence for image formation in a comparative example.

Referring to FIG. 3, a description is given of a diagram illustrating a potential sequence for image formation in a comparative example.

In this exemplary embodiment, the controller 30 causes the charging roller 3 to supply a charging voltage of −500 [V] to the charging roller 3 during the image formation. With this charging operation of the charging roller 3, the surface of the photoconductor 2 is uniformly charged to −500 [V], which is a target charging potential. By contrast, when the optical writing device 6 optically exposes the thus uniformly charged surface of the photoconductor 2, the voltage of the exposed portion on the surface of the photoconductor 2 drops to approximately −25 [V]. Hereinafter, the charging potential at the photoconductor 2 (i.e., the electric potential at an area on which the latent image is not formed) caused by the charging operation by the charging roller 3 is indicated as "Vd" and the electric potential at the exposed portion (i.e., an electric potential at an area on which the latent image is formed) caused by the charging operation of the charging roller 3 is indicated as "VL". Further, a surface potential of the developing roller 4*a* when the development voltage is supplied during image formation is indicated as "Vb". The development voltage of this exemplary embodiment is set to 150 [V], and at the same time the surface potential Vb of the developing roller 4*a* is also set to 150 [V].

In this exemplary embodiment of the present invention, the development potential (|VL−Vb|), which is an electric potential difference between the latent image area potential VL (=−25 [V]) on the photoconductor 2 and the surface potential Vb (=−150 [V]) on the developing roller 4*a*, equals to 125 [V] in a period C corresponding to a latent image formed area. Due to the development potential, the toner having the negative polarity on the developing roller 4*a* is affected by the development field in which toner is transferred onto the latent image formed portion (i.e., the exposed portion) of the photoconductor 2, and therefore the toner is attached to the latent image formed portion of the photoconductor 2.

By contrast, a background potential (|Vd−Vb|), which is a potential difference between the non-latent image formed portion potential Vd (=−150 [V]) on the photoconductor 2 and the surface potential Vb (=−150 [V]) on the developing roller 4*a*, equals to 350 [V]. Due to the background potential, in the non-latent image formed portion (i.e., a non-exposed portion) on the photoconductor 2, the reversing development field in which toner having the negative polarity on the developing roller 4*a* is attracted toward the developing roller 4*a* is affected, and therefore the toner is prevented from being attached to the non-latent image formed portion on the photoconductor 2.

In this exemplary embodiment, when instructions to start the image formation are inputted, an image formation start operation is performed as a preparing operation before the image formation. Further, when the image formation is completed, if no instructions for starting next image formation are issued, an image formation end operation is performed so that the status of the image forming apparatus moves to a standby state.

In the image formation start operation, the photoconductor 2, the developing roller 4*a* and the regulating roller 4*b* of the development unit 4, the intermediate transfer belt 8 and so forth are started and continuously driven in the image formation start operation state until these members achieve the stable driving state at the target speed. In this exemplary embodiment, the surface potential of the photoconductor 2 is set to substantially 0 [V] before the image formation start operation. A following description is given to show the reasons.

In this exemplary embodiment of the present invention, when the image formation end operation is performed, the charged electricity discharging unit 33 performs the electrical discharging operation without outputting the charging voltage to the charging roller 3. In this charged electricity discharging operation, an electrical discharging light is uniformly emitted to the surface of the photoconductor 2 to remove the surface potential of the photoconductor 2. At this time, the surface potential of the photoconductor 2 is −25 [V], which is approximately same as the latent image area potential VL and the value is close to 0 [V]. Further, during the image formation start operation, the charging operation performed by the charging roller 3 remains stopped. Accordingly, even when the image formation start operation is performed immediately after the image formation start operation, the surface potential of the photoconductor 2 keeps the voltage to −25 [V], which is substantially 0 [V]. However, the surface potential of the photoconductor 2 gradually falls as the time elapses after the charging operation performed by the charging roller 3 has stopped. Therefore, if the period between the completion of the image formation end operation and the start of the subsequent image formation start operation is rather long, the surface potential of the photoconductor 2 can fall to 0 [V].

In the comparative example as illustrated in FIG. 3, the image formation start operation is performed after a certain period of time has elapsed from the completion of the previous image formation end operation and the surface potential of the photoconductor 2 during the image formation start operation is 0 [V]. At this time, in the comparative example in FIG. 3, the controller 30 controls to reverse the polarity of output voltage of the developer power source 31 to output a reverse development voltage Vr to the developing roller 4*a*, so as to prevent occurrence of unnecessary attraction of toner (to a non-charged surface) in which a very small amount of toner held on the surface of the developing roller 4*a* is attracted to the surface of the photoconductor 2 during the image formation start operation. The reverse development voltage Vr has the opposite (i.e., positive) polarity to the development voltage Vb and the absolute value thereof is set identical to the absolute voltage of the development voltage Vb. With this setting, in the development area during the image formation start operation, an electric potential difference (=150 [V]) is generated between the surface potential (=0 [V]) of the photoconductor 2 and the surface potential Vr (=+150 [V]) of the developing roller 4*a* in a period A in which the image formation start operation is performed. This potential difference generates a reversing development field in the development area, resulting in attraction of the toner having the negative polarity to the developing roller 4*a*. Therefore, the toner on the developing roller 4*a* is held thereon without being transferred onto the surface of the photoconductor 2 during the image formation start operation, thereby preventing occurrence of unnecessary attraction of toner to the photoconductor 2.

As described above, the image forming apparatus 100 according to this exemplary embodiment employs a one-component developer developing method and has the advantage of low cost configuration. Therefore, the developer power source 31 of this exemplary embodiment has the minimum capacity necessary for image formation. The development voltage Vb according to this exemplary embodiment is set to −150 [V], which is a relatively low value, and therefore the developer power source 31 of this exemplary embodiment has a small capacity having the maximum output voltage of substantially 150 [V] that is necessary for outputting the development voltage Vb. As a result, the absolute value of the maximum output voltage that can be applied to the developing roller 4*a* should be set to 150 [V] or smaller.

Here, if toner filming occurs on the surface of the developing roller 4*a* due to long-term use of toner, the charging amount of toner on the developing roller 4*a* to be conveyed to the development area drops, as previously described. For such toner with the reduced charging amount, even if a potential difference of approximately 150 [V] is created in the development area during the image formation start operation (corresponding to a period A), the toner cannot be attracted to the developing roller 4*a* sufficiently. Therefore, in the comparative example as illustrated in FIG. 3, if the above-described toner filming occurs, unnecessary attraction of toner occurs beyond a permissible level.

The above-described operation is also performed during the image formation end operation. Specifically, during the image formation end operation, the surface potential of the photoconductor 2 uniformly indicates −25 [V], which is substantially 0 [V], due to the electrical discharging operation performed by the charged electricity discharging unit 33. Therefore, unnecessary attraction of toner can occur even during the image formation end operation. For this reason, in the comparative example illustrated in FIG. 3, same as the period of the image formation start operation, the controller 30 controls to reverse the polarity of output voltage of the developer power source 31 to output the reverse development voltage Vr to the developing roller 4*a* even during the image formation end operation. At this time, a potential difference (=175 [V]) is created between the surface potential of the photoconductor 2 (=−25 [V]) and the surface potential Vr of the developing roller 4*a* (=+150 [V]) in the development area in a period D corresponding to the image formation end operation. With this setting of the potential difference, the toner on the developing roller 4*a* is held thereon without being transferred onto the surface of the photoconductor 2 during the image formation end operation, thereby preventing occurrence of unnecessary attraction of toner to the photoconductor 2. However, if the charging amount of toner falls due to toner filming, same as the image formation start operation, unnecessary attraction of toner can occur beyond a permissible level.

Figure 4:
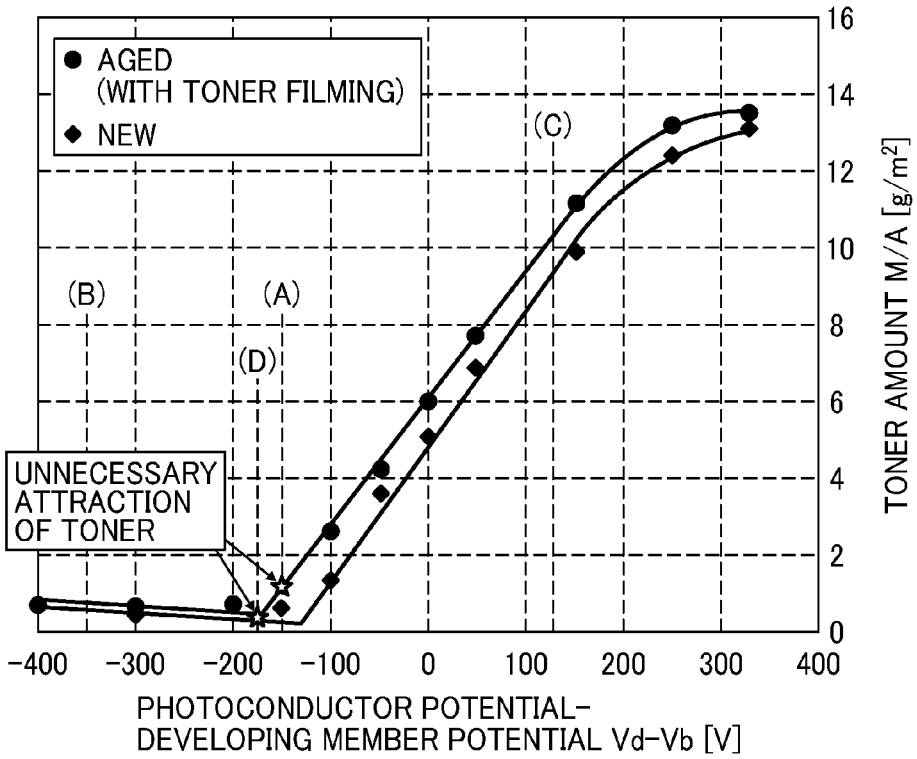
FIG. 4 is a graph illustrating a relation between an electric potential difference between an electric potential at a surface of a photoconductor and an electric potential at a surface of a developing roller and an amount of waste toner produced due to unnecessary attraction of a small amount of toner or background contamination in the comparative example.

In the comparative example of FIG. 3, FIG. 4 is a graph illustrating a relation between an electric potential difference between an electric potential at the surface of the photoconductor 2 and an electric potential at the surface of the developing roller 4*a* and an amount of waste toner produced due to unnecessary attraction of toner or background contamination, which is a phenomenon that toner adheres to a non-latent image formed portion during the image formation.

FIG. 4 shows an example in which a developing roller has toner filming on the surface thereof due to age and another example in which a new developing roller has no toner filming on the surface at the initial toner state.

As illustrated in the graph of FIG. 4, when the developing roller having toner filming on the surface thereof is compared with the developing roller at the initial toner state having no toner filming on the surface thereof, the amount of waste toner increases more in the developing roller with age due to unnecessary attachment of toner during the image formation start operation, the image formation end operation, or background contamination during the image formation. Accordingly, once toner filming occurs, the amount of waste toner increases. Further, the capacity of the waste toner container 14 is designed as that no toner filming occurs. Therefore, once toner filming occurs, the amount of waste toner exceeds the capacity of the waste toner container 14, which causes the waste toner container 14 to be full easily.

Figure 5:
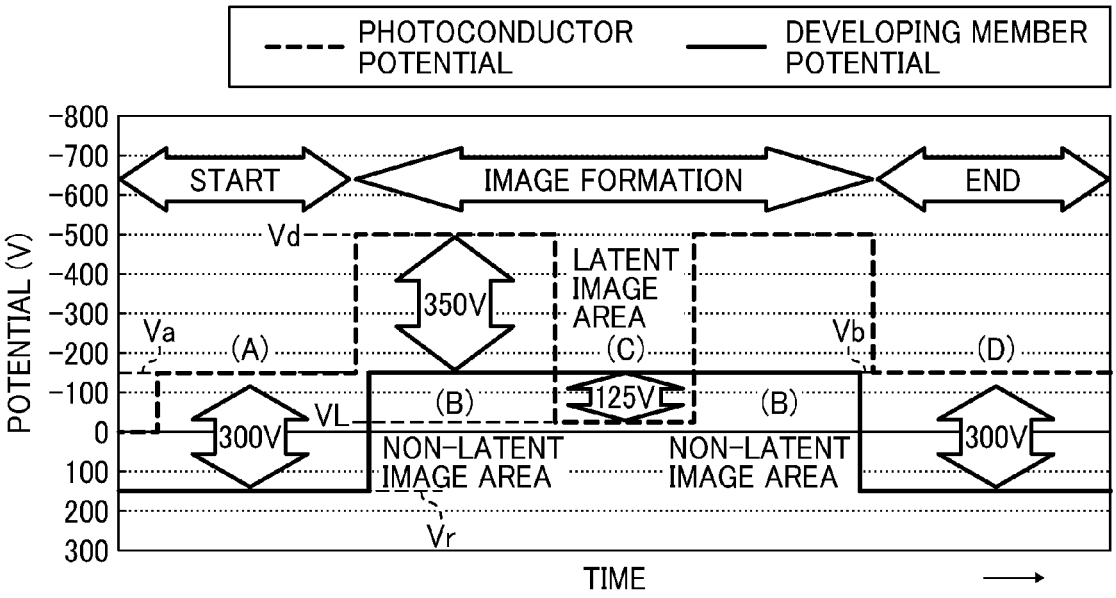
FIG. 5 is a diagram illustrating an electric potential sequence for image formation in an exemplary embodiment.

FIG. 5 is a diagram illustrating a potential sequence for image formation of an exemplary embodiment.

In FIG. 5 of the exemplary embodiment, the definition of the periods A through D is same as those described with the comparative example illustrated in FIG. 3.

In this exemplary embodiment, even if toner filming occurs, occurrence of unnecessary attachment of toner is minimized during the image formation start operation and/or the image formation end operation, so as to reduce the amount of waste toner. Specifically, as illustrated in FIG. 5, while the developer power source 31 is outputting the reverse development voltage Vr, with respect to the surface of the photoconductor 2 that is passing the development area. A development restraining potential Va that has the same negative polarity as the toner and an absolute value smaller than a target charging potential Vd is provided. The development restraining potential Va is set to −150 [V] in this exemplary embodiment. That is, the respective potential differences between the surface potential at the photoconductor 2 and the surface potential at the developing member 4*a* during the image formation start operation (i.e., the period A) and the image formation end operation (i.e., the period D) are 300 [V]. However, the value is not fixed and is optionally settable in a range in which a sufficient potential difference between the surface potential of the photoconductor 2 and the development restraining potential Va to prevent unnecessary attachment of toner can be set.

CONFIGURATION EXAMPLE 1

Configuration Example 1 can provide a developer reducing potential applier for supplying the development restraining potential Va to the surface of a photoconductor 2 that, for example, charges the surface of the photoconductor 2 to the development restraining potential Va with the charging roller 3. In this Configuration Example 1, the controller 30 causes the charger power source 32 to supply a charging voltage of −150 [V] to the charging roller 3 during the image formation start operation and/or the image formation end operation. However, in this case, it is necessary to use a power source (i.e., the charger power source 32) that can reliably output both the charging voltage of −500 [V] during the image formation and the charging voltage of −150 [V] during the image formation start operation or the image formation end operation.

CONFIGURATION EXAMPLE 2

Configuration Example 2 can provide a developer reducing potential applier for supplying a development restraining potential Va on the surface of the photoconductor 2 that, for example, charges the surface of the photoconductor 2 to have the same negative polarity as the toner and the absolute value of an electric potential greater than the development restraining potential Va, and then decreases the electric potential at the surface of the photoconductor 2 to the development restraining potential Va by uniformly exposing the surface by the optical writing device 6.

In this Configuration Example 2, to obtain the development restraining potential Va of −150 [V] by adjusting the exposure power of the optical writing device 6, the charging voltage that the charger power source 32 outputs to the charging roller 3 during the image formation start operation or the image formation end operation can be same as the charging voltage during the image formation. Therefore, in this case, a less expensive power source can be employed as the charger power source 32. However, in this case, it is necessary to adjust the exposure power of the optical writing device 6. Since this exemplary embodiment employs the optical writing device 6 that can adjust the exposure power, the configuration in Configuration Example 2 can be achieved without adding a new unit or component.

Figure 6:
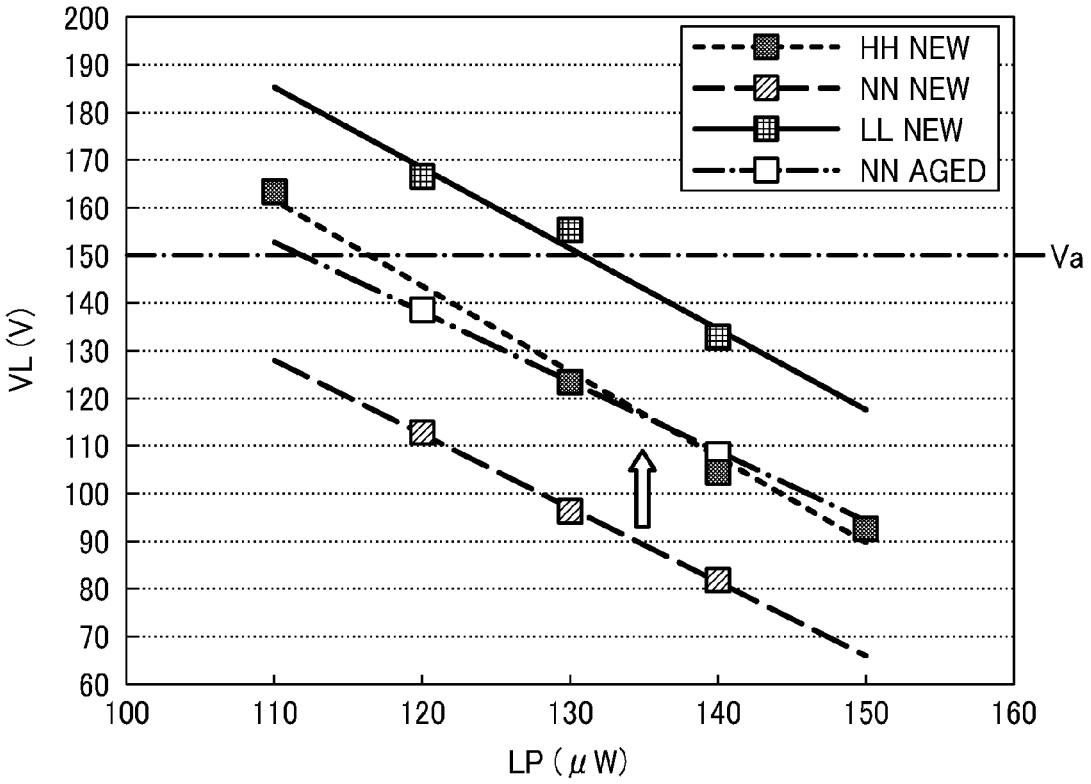
FIG. 6 is a graph illustrating a relation between an exposure power of an optical writing device and an electric potential at an electrostatic latent image in the exemplary embodiment.

FIG. 6 is a graph illustrating a relation between an exposure power LP of the optical writing device 6 and a latent image area potential VL in the exemplary embodiment.

The graph of FIG. 6 shows three environments, which are an HH (high-temperature, high-humidity) environment, generally in a range of from 30° C. and 90% to 33° C. and 80%, an NN (normal-temperature or middle-temperature, normal-humidity or middle-humidity) environment, generally in a range of from 20° C. and 60% to 25° C. and 70%, and an LL (low-temperature, low-humidity) environment, generally in a range of from 5° C. and 10% to 10° C. and 15%. Under these conditions, verification and evaluation of devices and units were conducted. In this exemplary embodiment, we selected the temperature of 27° C. and the humidity of 80% for the HH environment, the temperature of 23° C. and the humidity of 50% for the NN environment, and the temperature of 10° C. and the humidity of 15% for the LL environment, and the results of the verification and evaluation under these environments are shown in the graph of FIG. 6. As shown in this graph of FIG. 6, a relation of the exposure power LP and the latent image area potential VL varies according to the hygrothermal environment, and therefore, it is preferable that the hygrothermal environment is taken into consideration in adjustment of the exposure power LP.

The graph of FIG. 6 further indicates the relation between the exposure power LP and the latent image area potential VL when the long-term used photoconductor 2 is used in the NN environment. As you can clearly see through the results of comparison between the two lines in the NN environment in FIG. 6, as the photoconductor 2 is used for a long time and therefore the photoconductor characteristics are degraded, the relation between the exposure power LP and the latent image area potential VL varies. Accordingly, it is preferable to take the deterioration in photoconductor 2 into consideration when adjusting the exposure power LP.

In this exemplary embodiment, to obtain the development restraining potential Va of −150 [V] by adjusting the exposure power LP of the optical writing device 6, the exposure power LP should be set to approximately 130 [μW], for example in the LL environment, according to the graph of FIG. 6.

Figure 7:
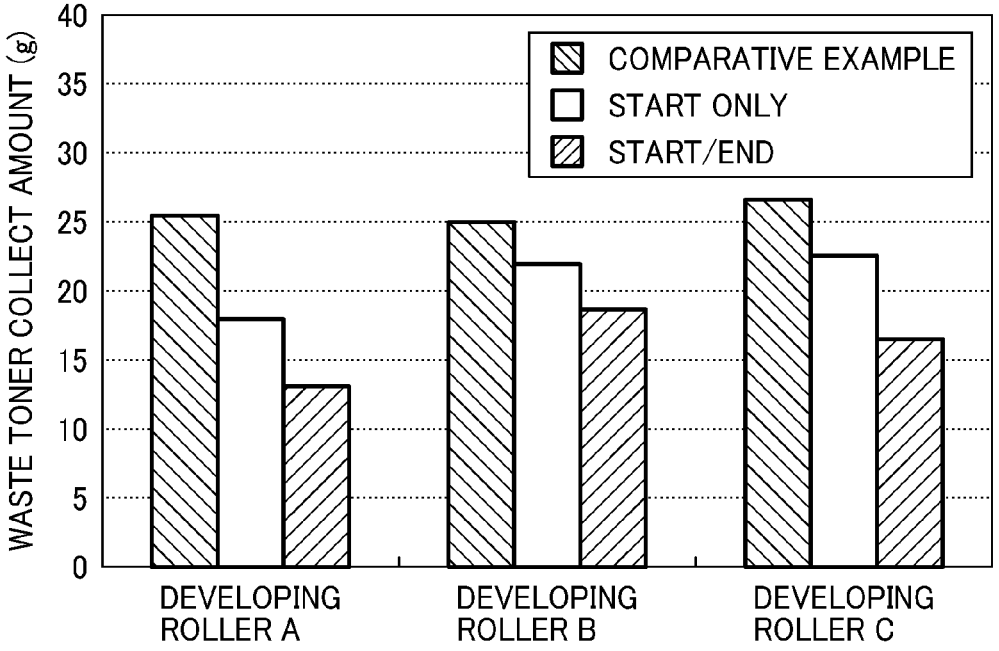
FIG. 7 is a graph illustrating results of an experiment conducted to check the effect of the exemplary embodiment of the present invention.

FIG. 7 is a graph illustrating the results of an experiment conducted to check the effect of the exemplary embodiment of the present invention.

In this experiment, we measured the amount of waste toner collected in the waste toner container 14 after printing 1,000 copies of a test image in the NN environment using three developing rollers A, B, and C. Specifically, we conducted the tests using the developing rollers A, B, and C for the same setting as the comparative example in FIG. 3 (that is, the setting in which the development restraining potential Va is not supplied to the surface of the photoconductor 2 during both the image formation start operation period and the image formation end operation period), a setting in which the development restraining potential Va is supplied to the surface of the photoconductor 2 only during the image formation start operation period, and another setting in which the development restraining potential Va is supplied to the surface of the photoconductor 2 during both the image formation start operation period and the image formation end operation period.

As shown in the graph of FIG. 7, in comparison with the setting of the comparative example of FIG. 3, we confirmed that each of the developing rollers A, B, and C can reduce the amount of waste toner if the development restraining potential Va is supplied. Especially, we confirmed that the amount of waste toner can be substantially reduced in the setting in which the development restraining potential Va is supplied to the surface of the photoconductor 2 during both the image formation start operation period and the image formation start operation period.

CONFIGURATION EXAMPLE 3

Further, for another example of a developer reducing potential applier, a member that applies the development restraining potential Va on the surface of the photoconductor 2 by supplying a voltage to a conductive substrate of the photoconductor 2, as shown in Configuration Example 3.

It is to be noted that, in this exemplary embodiment, the surface potential of the photoconductor 2 is forcedly set to substantially 0 [V] by the charged electricity discharging unit 33 during the image formation end operation. However, even without the electrical discharging operation performed by the charged electricity discharging unit 33, if a given time has elapsed since when the charging operation performed by the charging roller 3 is stopped, the surface potential of the photoconductor 2 is substantially 0 [V]. Therefore, the description in this exemplary embodiment is the same whether the electrical discharging operation by the charged electricity discharging unit 33 is performed during the image formation end operation period or no charged electricity discharging unit 33 is provided in the image forming apparatus 100.

The above-described embodiments of the present invention can achieve the specific effects in each of the following aspects.

(Aspect A)

The image forming apparatus 100 that forms an image on the recording medium by transferring a toner image formed on the latent image bearing member with toner attracted onto an electrostatic latent image thereto includes a rotatable image bearing member such as the photoconductor 2, a charging unit such as the charging roller 3 that charges the surface of the latent image bearing member to the target charging potential Vd having the same negative polarity as the toner, an exposure unit such as the optical writing device 6 to expose the charged surface of the latent image bearing member based on image data to reduce the electric potential at an exposed portion of the surface of the latent image bearing member, and a developing unit such as the developing unit 4 including the layer thickness regulator such as the regulating roller 4*b* that regulates a thickness of layer of toner carried on the surface of the toner bearing member such as the developing roller 4*a*. At the same time the developing unit 4 charges the toner with friction by slidably contacting the surface of the toner bearing member and conveys the charged toner along with movement of the surface of the toner bearing member to the development area where the toner faces the surface of the latent image bearing member. Further, while the development voltage Vb having the same negative polarity as the toner is output from the developer power source 31 to the toner bearing member, the developing unit attracts the toner on the toner bearing member to the exposed portion on the latent image bearing member with the developer power source 31 using the potential difference (that is, a development potential) between the potential Vb of the surface of the toner bearing member and the potential VL of the exposed portion on the surface of the latent image bearing member in the development area. In such an image forming apparatus, the reverse development voltage controller such as the controller 30 that outputs the reverse development voltage Vr having the opposite polarity to the development voltage Vb from the developer power source 31 to the toner bearing member during a period in which the surface of the latent image bearing member without the charging operation performed thereon passes the development area, and a developer reducing potential applier to supply the development restraining potential Va, the polarity of which is same as the regular charging polarity of toner (i.e., a negative polarity) and the absolute value of which is smaller than the target charging potential Vd, to the surface of the latent image bearing member that passes the development area while the reverse development voltage Vr is output from the developer power source 31.

Accordingly, even if the configuration includes the developer power source 31 with low capacity that can supply a small amount of voltage of the absolute value as the reverse development voltage Vr, a difference in potential between the surface of the toner bearing member (i.e., the developing roller 4*a*) applied with the reverse development voltage Vr and the surface of the latent image bearing member can be large. Therefore, even if the amount of charged toner is insufficient due to toner filming on the toner bearing member, toner can be retained to the toner bearing member in the development area reliably.

(Aspect B)

According to Aspect A, the developer reducing potential applier applies the development restraining potential Va to the surface of the latent image bearing member by causing the charging member to charge the surface of the latent image bearing member to the development restraining potential Va.

With this action, the development restraining potential Va can be applied in a simple configuration.

(Aspect C)

According to Aspect A, the developer reducing potential applier applies the development restraining potential Va to the surface of the latent image bearing member by causing the charging member 3 to charge the surface of the latent image bearing member to have a polarity same as the regular charging polarity of toner (i.e., a negative polarity) and have a potential with the absolute value greater than the development restraining potential Va and then causing the optical writing device to expose the surface of the latent image bearing member to reduce the potential to the development restraining potential Va.

With this action, the development restraining potential Va can be applied at lower cost.

(Aspect D)

According to Aspect A, the latent image bearing member is the photoconductor 2 with a conductive layer being formed on an outer surface of a conductive substrate thereof, the developer reducing potential applier applies the developer reducing potential to the surface of the latent image bearing member by supplying a voltage to the conductive substrate of the latent image bearing member.

With this action, the development restraining potential Va can be applied in a simple configuration.

(Aspect E)

According to any one of Aspects A through D, the developer reducing potential applier applies the developer reducing potential to substantially match a difference in potential between the potential Vr of the surface of the toner bearing member to which the reverse development voltage Vr is output and the development restraining potential Va with a difference in potential (development potential) generated during the image formation between the potential Vb of the surface of the toner bearing member to which the development voltage is output and the potential Vd of the non-exposed portion on the surface of the latent image bearing member.

With this action, the amount of attraction of a very small amount of toner to the surface of the latent image bearing member can be reduced to the level same as the background restraining level.

(Aspect F)

According to any one of Aspects A through E, the period in which the reverse development voltage controller outputs the reverse development voltage Vr from developer power source 31 to the toner bearing member is a period corresponding to the image formation start operation period before the start of image formation or the image formation end operation period after the completion of image formation.

With this configuration, even if the amount of charged toner is insufficient due to toner filming, attraction of toner to the latent image bearing member caused during the image formation start operation period or the image formation end operation period can be prevented.

(Aspect G)

According to any one of Aspects A through F, the developer reducing potential applier applies the development reducing potential to the latent image bearing member such that the difference in potential between the surface potential Vr at the surface of the toner bearing member to which the reversing development voltage Vr is output and the development restraining potential Va is set to a range of from 250 [V] to 350 [V].

With this configuration, even if the amount of charged toner is insufficient due to toner filming, occurrence of attraction of toner to the latent image bearing member can be prevented reliably.

The above-described embodiments are illustrative and do not limit the present invention. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

What is claimed is:

1. An image forming apparatus for transferring an image to which toner is attracted onto a recording medium, the image forming apparatus comprising:

a rotatable photoconductor configured to carry an electrostatic latent image on an outer surface thereof;

a charging unit, connected to a first power source, configured to charge the surface of the photoconductor to a target charging potential having the same polarity as the toner;

an exposure unit configured to expose a portion of the charged surface of the photoconductor based on image data such that an electric potential at the exposed portion of the surface of the photoconductor is reduced;

developing unit including a toner bearing member and a layer thickness regulator, the developing unit connected to a second power source configured to output a development voltage having the same polarity as that of the toner bearing member, the toner bearing member configured to carry the toner on a surface thereof for developing the latent image on the photoconductor with the toner to form a toner image, and the layer thickness regulator configured to regulate a thickness of layer of the toner carried on the surface of the toner bearing member, the developing unit configured to:

charge the toner with friction by slidably contacting the surface of the toner bearing member and conveying the charged toner along with movement of the surface of the toner bearing member to a development area where the toner faces the latent image on the surface of the photoconductor, and attract the toner on the toner bearing member to the exposed portion on the surface of the photoconductor with the second power source using a difference in potential between the surface of the toner bearing member and the exposed portion of the surface of the photoconductor in the development area; and a controller configured to, cause the second power source to supply a reverse development voltage to the toner bearing member while a uncharged portion on the surface of the photoconductor passes the development area, the reverse development voltage having a polarity opposite a polarity of the development voltage, and cause the first power source to supply a development restraining voltage to the charging unit such that the charging unit produces a development restraining potential on the surface of the photoconductor that passes the development area while the reverse development voltage is supplied from the second power source to the toner bearing member, the development restraining voltage having a constant level while the reverse development voltage is supplied to the toner bearing member, a same polarity as the toner and an absolute value smaller than the target charging potential, the reverse development voltage being continuously constant from when the uncharged portion on the surface of the photoconductor passes the development area through when the development restraining voltage is supplied to the charging unit.

2. The image forming apparatus according to claim 1, wherein the controller is configured to cause the charging unit to charge the surface of the photoconductor to the development restraining potential.

3. The image forming apparatus according to claim 1, wherein the controller is configured to, first cause the charging unit to charge the surface of the photoconductor to a polarity identical to a regular charging polarity of toner and an electric potential with an absolute value greater than the development restraining potential, and after the first causing, then cause the exposure unit to expose the surface of the photoconductor to reduce the electrical potential to the development restraining potential.

4. The image forming apparatus according to claim 1, wherein the photoconductor comprises:

a conductive substrate and a conductive layer formed on an outer surface of the substrate, and wherein the controller is configured to apply the development reducing potential to the surface of the photoconductor by supplying a voltage to the conductive substrate of the photoconductor.

5. The image forming apparatus according to claim 1, wherein the controller is configured to apply the development reducing potential to substantially match a difference in potential generated between a potential at the surface of the toner bearing member to which the reverse development voltage is output and the development restraining potential with a difference in potential generated during the image formation between a potential at the surface of the toner bearing member to which the development voltage is output and a potential at a unexposed portion on the surface of the photoconductor.

6. The image forming apparatus according to claim 1, wherein a period in which the controller outputs the reverse development voltage from the second power source to the toner bearing member is one of an image formation start operation period before start of image formation and an image formation end operation period after completion of image formation.

7. The image forming apparatus according to claim 1, wherein the difference in potential generated between the potential at the surface of the toner bearing member to which the reversing development voltage is output and the development restraining potential ranges from 250 [V] to 350 [V].

8. The image forming apparatus according to claim 1, wherein the controller is configured instruct the first power source to supply the development restraining voltage at the constant level for a restraining interval, the restraining interval corresponding to an interval that a same reverse development voltage is supplied to the toner bearing member.

9. The image forming apparatus according to claim 1, further comprising:

a cleaning blade disposed upstream from the charging unit in a rotation direction of the photoconductor, the cleaning blade configured to remove the toner from the photoconductor after the latent image is transferred to an intermediate transfer member.

10. The image forming apparatus according to claim 1, wherein the controller is configured to supply the reverse development voltage to the toner bearing member via the second power source and the development restraining voltage to the charging unit via the first power source both before a start of an image formation and after a completion of the image formation.

* * * * *